US008289270B2

(12) United States Patent
Wallener et al.

(10) Patent No.: US 8,289,270 B2
(45) Date of Patent: Oct. 16, 2012

(54) ARRAY SCALING FOR HIGH DYNAMIC RANGE BACKLIGHT DISPLAYS AND OTHER DEVICES

(75) Inventors: Damir Wallener, North Vancouver (CA); Neil Messmer, Langley (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 668 days.

(21) Appl. No.: 12/464,777

(22) Filed: May 12, 2009

(65) Prior Publication Data

US 2009/0284459 A1 Nov. 19, 2009

Related U.S. Application Data

(60) Provisional application No. 61/052,723, filed on May 13, 2008.

(51) Int. Cl.
*G09G 3/36* (2006.01)

(52) U.S. Cl. ..... 345/102; 345/77; 345/83

(58) Field of Classification Search ..... 345/76–84, 345/87–102, 204–215, 690–691
See application file for complete search history.

(56) References Cited

U.S. PATENT DOCUMENTS

| | | | | |
|---|---|---|---|---|
| 7,002,547 | B2 | 2/2006 | Yamada | |
| 7,952,544 | B2 * | 5/2011 | Roberts | 345/87 |
| 2002/0030996 | A1 | 3/2002 | Sakakibara | |
| 2005/0116665 | A1 | 6/2005 | Colby et al. | |
| 2006/0082529 | A1 | 4/2006 | Oyama | |
| 2006/0103612 | A1 | 5/2006 | Ozaki | |
| 2006/0238465 | A1 | 10/2006 | Kurumisawa | |
| 2007/0001625 | A1 | 1/2007 | Kim | |
| 2007/0008255 | A1 | 1/2007 | Emek | |
| 2007/0046485 | A1 | 3/2007 | Grootes et al. | |
| 2007/0195025 | A1 | 8/2007 | Korcharz et al. | |
| 2007/0285378 | A1 | 12/2007 | Lankhorst | |
| 2008/0198112 | A1 * | 8/2008 | Roberts | 345/88 |
| 2008/0198114 | A1 * | 8/2008 | Roberts et al. | 345/88 |
| 2010/0194721 | A1 * | 8/2010 | Miyata et al. | 345/206 |
| 2011/0285763 | A1 * | 11/2011 | Bassi et al. | 345/694 |

FOREIGN PATENT DOCUMENTS

| | | | |
|---|---|---|---|
| JP | 2006314168 | A | 11/2006 |
| WO | 0127910 | A1 | 4/2001 |
| WO | 2007023454 | A1 | 3/2007 |
| WO | 2007035883 | A2 | 3/2007 |

* cited by examiner

*Primary Examiner* — Vijay Shankar

(57) ABSTRACT

Luminosity of individual LED light sources is measured and a forward voltage control of each LED is set so that each LED has a pre-determined (e.g., uniform) luminosity at a same modulation level. The LEDs are then driven via a modulation technique such as PWM, PCM, polyphase, etc. according to lighting requirements. The LEDs are, for example, a backlight of a dual modulation HDR LCD display system, and the lighting requirements are local dimming signals for the display.

26 Claims, 6 Drawing Sheets

ARRAY SCALING FOR HIGH DYNAMIC RANGE BACKLIGHT DISPLAYS AND OTHER DEVICES

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to the scaling or calibration of light arrays and more particularly to the scaling of LED backlight arrays used in display devices.

2. Discussion of Background

When used in applications such as backlighting for LCD or HDR displays, LED arrays generally require a calibration method to ensure all the elements of the array have a consistent luminance output. HDR displays typically have the additional requirement that a selection of LEDs—or possible the entire array of LEDs—be controllable at frame rates compatible with video transmission standards. This means any given LED or selection of LEDs not only have a predictable light output at one operating point, but at many operating points.

One technique is to rely on binning of LEDs by the manufacturer. This allows the implementer to specify an allowable variation in LED output, and only purchase LEDs that meet the requirement, but does so at increased costs.

SUMMARY OF THE INVENTION

The present inventors have realized the significant constraints imposed on current LED arrays due to calibrations and the need to maintain a wide range of brightness intensities on an element-by-element basis in arrayed lights, particularly for backlights of display devices, and the need to maintain a consistent range of LED brightness's for HDR displays. In one embodiment, the present invention uses voltage variance to implement luminance calibration to define one operating point, thereby preserving full range control of the LED intensity at all other operating points. As described in more detail herein, in various embodiments, the present invention provides for the use of different simultaneous voltages based on optical response to provide uniform brightness.

In one embodiment, the present invention provides a method of luminance scaling, comprising the steps of, applying a calibrated brightness control signal to a light source, and controlling a brightness of the light source using a modulation technique. The light source comprises, for example, an LED and the calibrated brightness control signal comprises, for example, a forward voltage of the LED. The modulation technique is preferably PWM, but may be any of PWM, PCM, polyphase, others etc. The invention is performed, for example, by applying the calibrated brightness control signal to each LED in an array of LEDs in a backlight of an LCD display, and then modulating each LED (or clusters of LEDs) according to desired backlight modulation derived on-the-fly from an image signal.

In another embodiment, the present invention is a backlight controller, comprising, a voltage control device configured to set each light source of a backlight to a calibrated light output, and a light source driver configured to modulate each light source to produce a desired light output from each light source, wherein the voltage control and drive control of the backlight controller function independently. In one embodiment, each light source comprises an LED and the light source driver modulation is configured to be capable of producing low drive values, and a resultant low light output of each LED not reachable via a gain-offset approach. The calibrated light output is, for example, a maximum light output of the light source.

In one embodiment, each light source comprises a plurality of LEDs, and the controller prepares a calibrated light output signal for each LED individually and a single modulation signal for the light source as a whole. In one embodiment, the light source comprises a plurality of LEDs including color LEDs, and the controller, in addition to a light output signal calibrated for each LED, provides separate modulation signals for each color of the light source.

The invention is practiced, for example, as part of a High Dynamic Range (HDR)(greater than 800:1 contrast ratio) dual modulation display comprising, for example, an array scaled backlight according to the present invention and an LCD screen. The array scaled backlight is then locally dimmed via at least one of a Pulse Width Modulation (PWM), Pulse Code Modulation (PCM), and polyphase modulation technique.

The predetermined luminosity for each LED comprises, for example, a uniform luminosity across the backlight. In one embodiment, the predetermined luminosity varies for each LED depending on its size and/or placement within the backlight. The predetermined luminosity values may be increased over time to compensate for dimming that occurs due to aging of the light sources.

In yet another embodiment, the present invention is a method comprising the steps of, measuring light output of an array of LEDs, determining a calibration value for each LED indicative of a uniform luminosity, storing the calibration value, adjusting a forward voltage of each LED based on the calibration value, and driving the LED array according to a video signal based on a modulation technique that is independent of the forward voltage adjustment.

Portions of both the device and method may be conveniently implemented in programming on a general purpose computer, or networked computers, and the results may be displayed on an output device connected to any of the general purpose, networked computers, or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable(s), and co-ax cable(s), etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
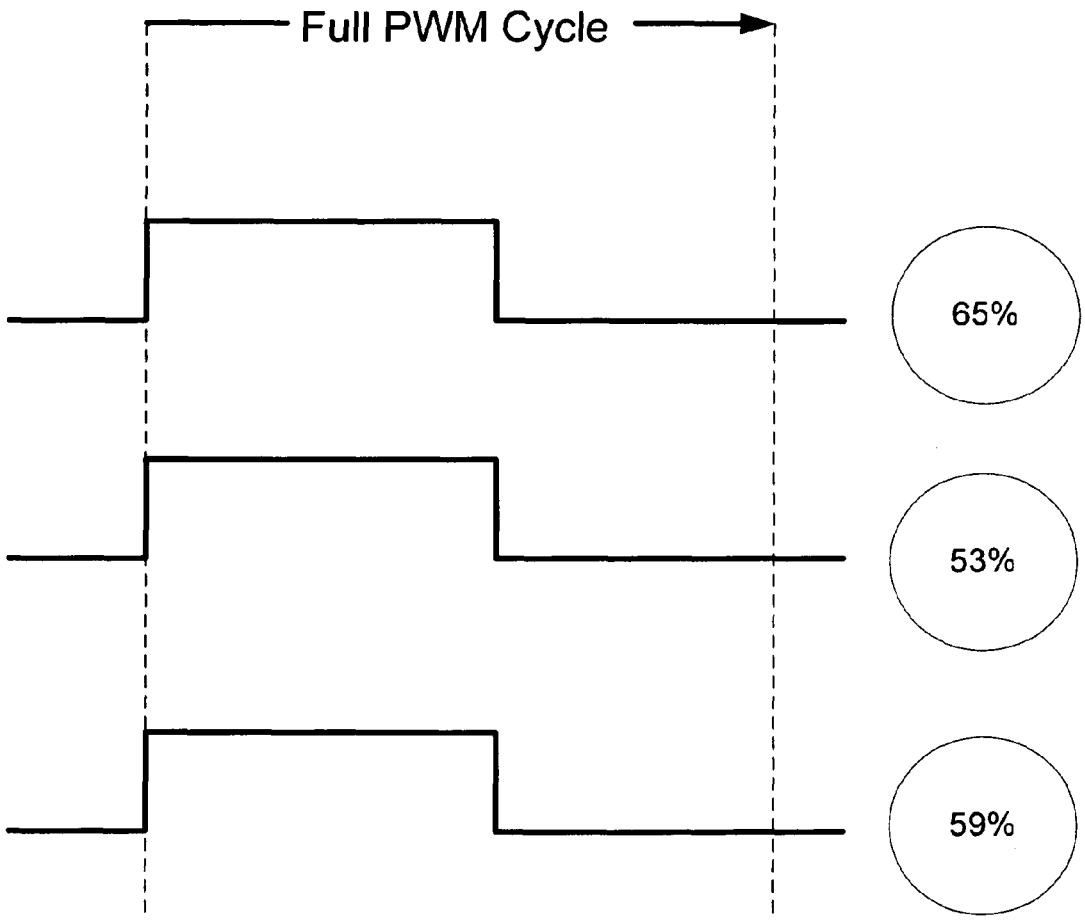
FIG. 1 is an illustration of binning for control of LED brightness via PWM.

Referring now to the drawings, wherein like reference numerals designate identical or corresponding parts, and more particularly to FIG. 1 thereof, there is illustrated an LED arrangement based on binning that allows an implementer to specify an allowable variation in LED output, and only purchase LEDs that meet the requirement. In this example, each LED is binned between 59 and 65% brightness for a given drive level.

The disadvantage of this technique is that binning of LEDs to low variance levels is expensive in both cost and time. An alternate technique that allows for less restrictive LED binning requirements involves calibration of the LED array or string. This would typically be done by driving each individual array to a known operating point (e.g., specific voltage and current) and measuring its light output with an optical instrument. A mathematical model such as a 'gain-offset' model shown below would then be constructed to determine how any given LED is driven to produce a specific light output.

$$PWM(\text{actual})=[PWM(\text{desired})*\text{Gain}]+\text{Offset}$$

The parameters Gain and Offset are determined uniquely for each LED, using the data collected during the calibration process. Gain is analogous to stretching the length of the PWM control signal, and Offset represents an increase in the minimum value or length of the PWM control signal above it's nominal minimum value of '0'.

Figure 2:
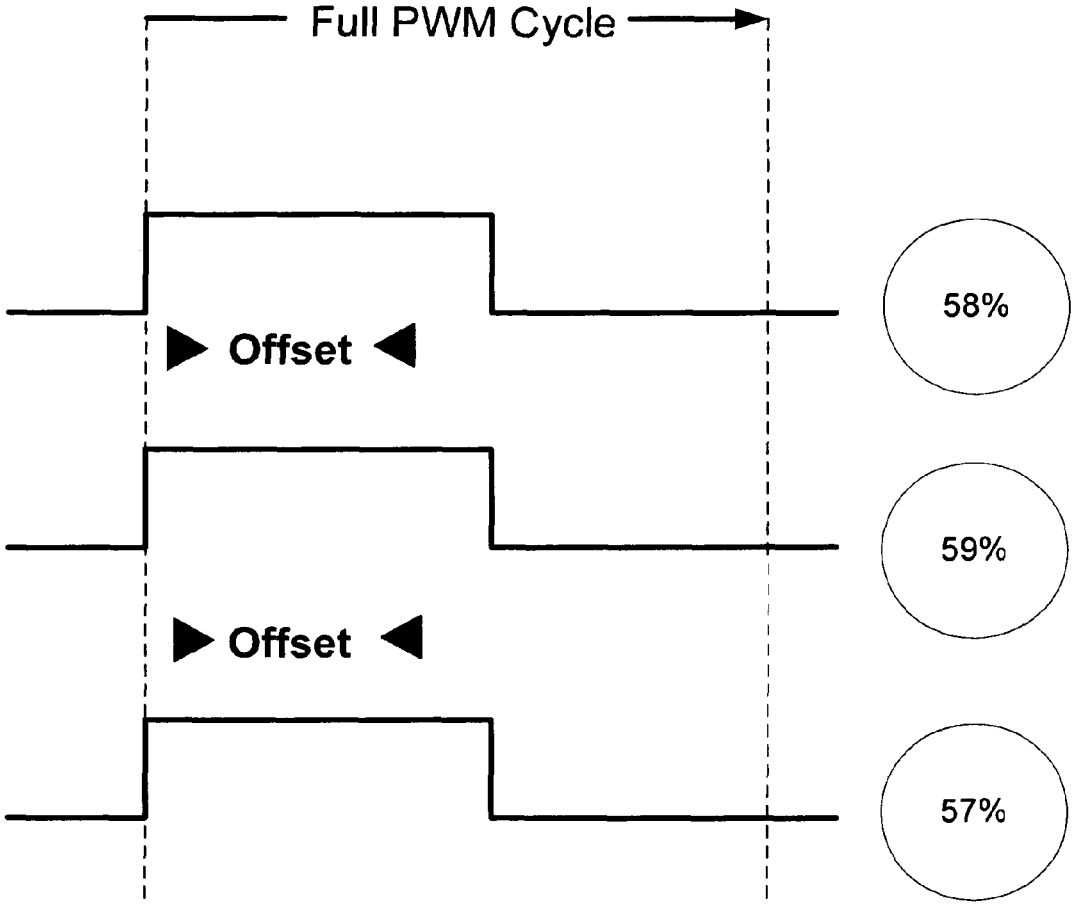
FIG. 2 is an illustration of an Offset approach to LED driving.

While conceptually straightforward, this model has a significant limitation in applications such as HDR displays where any given LED may be driven between minimum and maximum operating points with great frequency. The Offset parameter means that many LEDs will not be drivable at extremely low operating points as the minimum possible drive level is Offset. The Gain parameter implies a loss of PWM precision as fewer bits of PWM control are actually usable across the drive range established by the calibration process. This is illustrated in FIG. 2.

The use of Gain and Offset parameters is intended to create a wide range of control where the LEDs will all respond in a similar manner. However the Offset parameter means some LEDs are not driven at certain low values, meaning some parts of the light field generated by the LED array will not be correct and the resultant image will suffer. Referring to FIG. 2, if the desired output value is of low magnitude, the PWM cycle will decrease to its minimum possible value, which will be above it's nomimal minimum value. On a chart, this would be a 'shrinking' of the PWM cycle. However, at the very lowest value, the LED control signal will be higher than it's theoretical lowest value, so the controlling program and/or circuit will be unable to maintain correct light output. The visual result as the LED control signal gets shorter and shorter is that the LED gets dimmer up to a point, then simply turns off for an extended number of control values.

In an HDR display, the practical consequence of the above is that the modulation range of the backlight is constrained by the calibration process. The present invention overcomes this obstacle by separate control of the voltage and current being supplied to the LEDs. A possible embodiment 300 is illustrated in FIG. 3.

Figure 4:
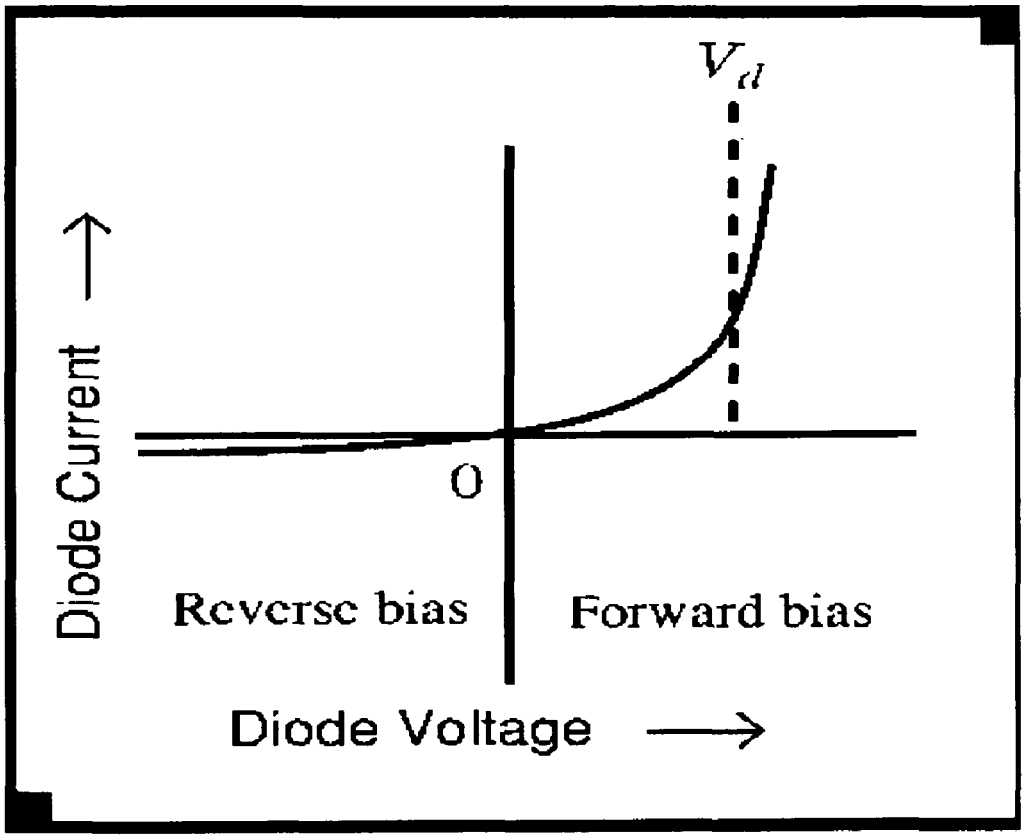
FIG. 4 is a drawing of a voltage-current relationship for a typical LED.

The calibration data can be collected as normal and stored, for example, in a calibration value memory 320 of a voltage control unit 310. However instead of being used to control the PWM cycle, it is used only to control the voltage supplied to the LEDs. The intent is to take advantage of the I-V (Current-Voltage, shown in FIG. 4) relationship of the LED.

The light output of an LED is proportional to the current supplied to the device. The maximum current an LED will absorb—regardless of what is supplied—is in turn determined by the voltage (often called the "forward voltage"). Therefore, by carefully selecting a forward voltage for any given LED, it is possible to accurately control its maximum light output. Taking this one step further, for an array of more or less equivalent LEDs, it is possible to guarantee or obtain equivalent light output of each LED (ie, calibrated light output) by controlling the forward voltage for each LED individually.

Figure 3:
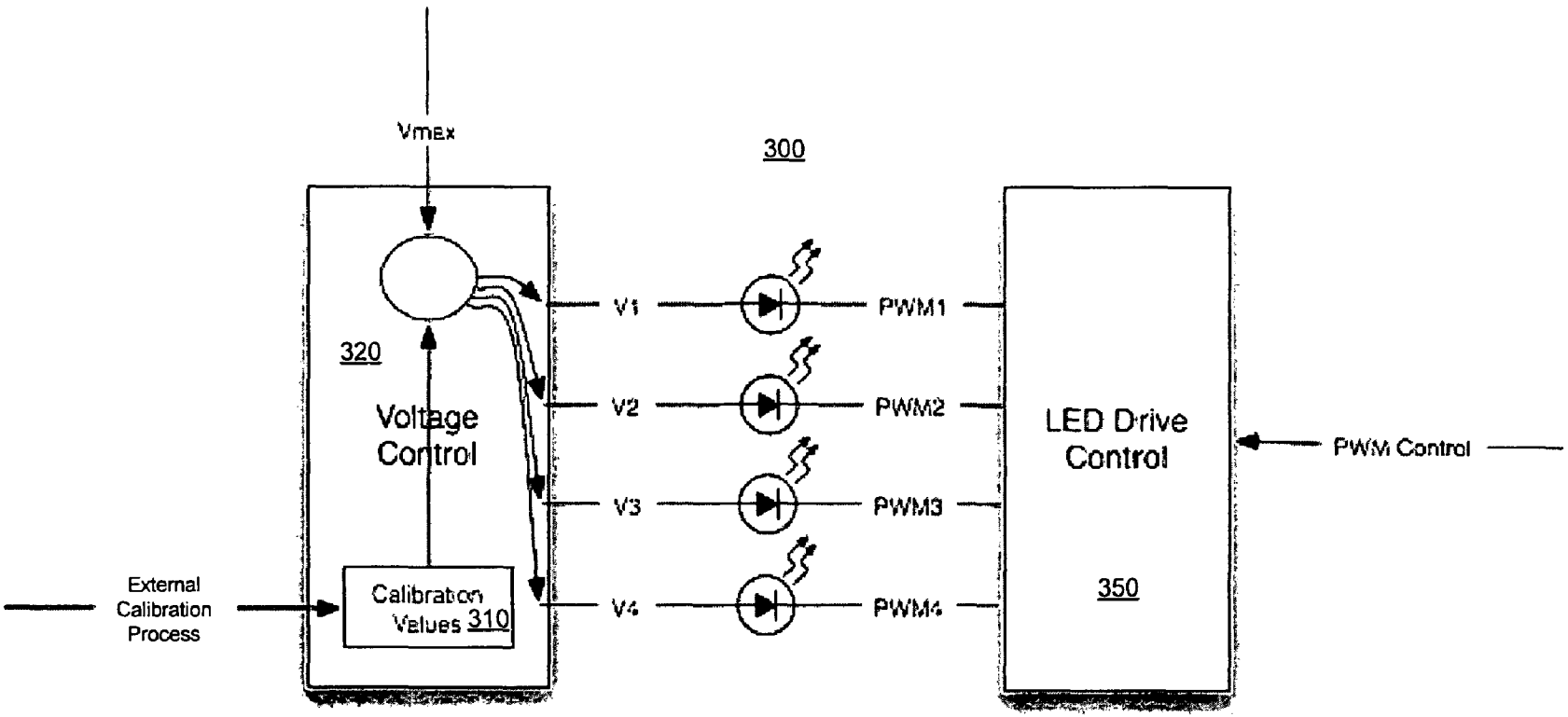
FIG. 3 is a schematic diagram of an LED controller (voltage control and drive control) according to an embodiment of the present invention.

As shown in FIG. 3, voltage V1 is, for example, representative of (e.g., proportional to) the measured light intensity output of LED1 such that a maximum light output of LED1 is the same as the other LEDs—or, alternatively, such that a similar drive level of the LEDs all reach a similar light output intensity. Likewise, voltage V2 is representative of the measured light intensity output of LED2, and so forth. LED drive control unit 350 provides the PWM cycle, and, like voltage control unit 310, is individually connected to each LED. Alternatively, the PWM could be connected to groups or clusters of LEDs.

Figure 5:
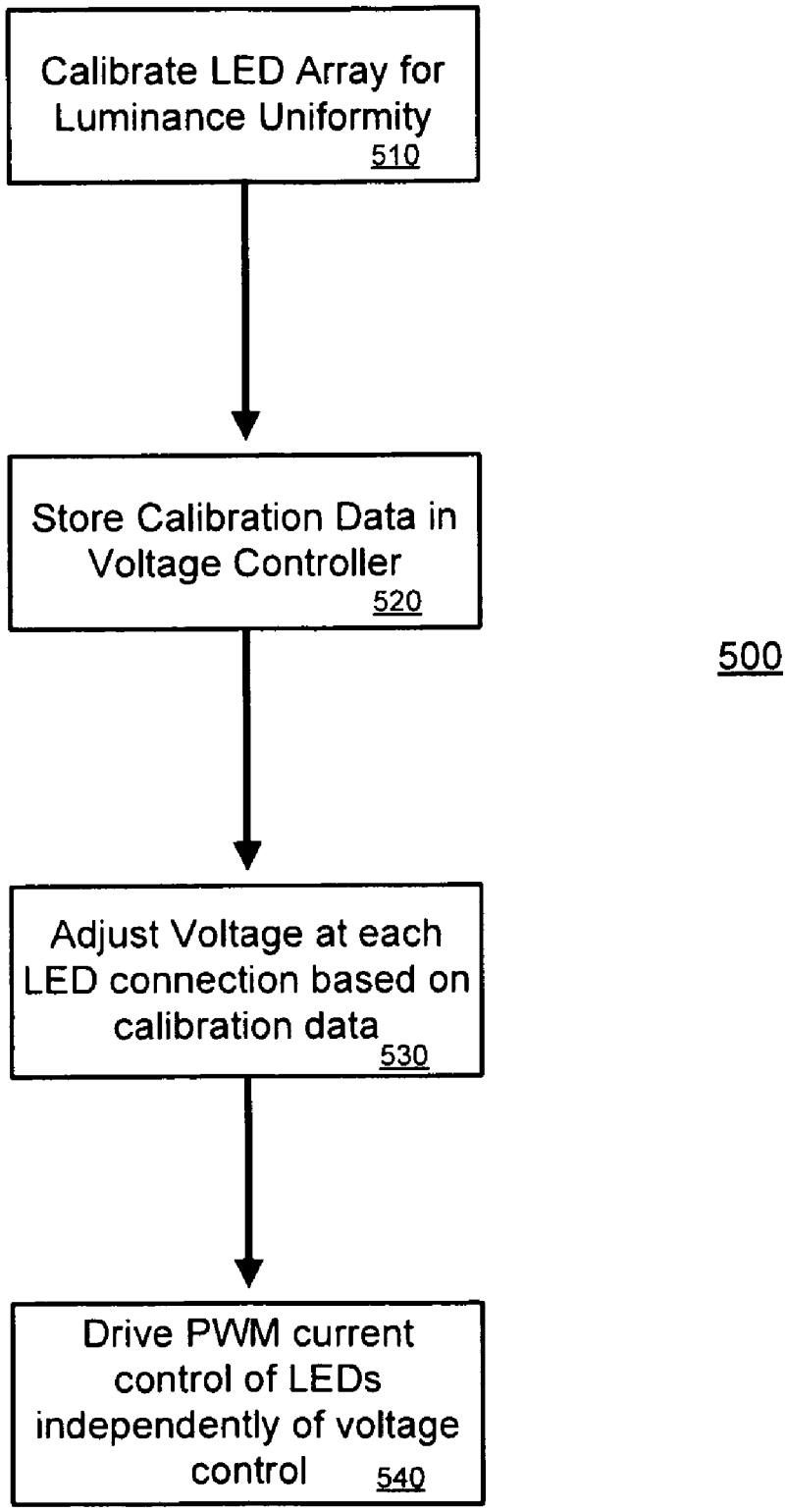
FIG. 5 is a flow chart of a process according to an embodiment of the present invention.

A process 500 according to an embodiment of the present invention is illustrated in FIG. 5. At step 510, each light source (e.g., each LED in an LED array) is calibrated for luminance uniformity. The calibration is, for example, a forward voltage for each LED such that each LED's highest luminance (or other calibration point) is uniform. At step 520, the values of the calibration or representatives of the calibration are stored (e.g., stored in calibration values memory 320).

Using the calibration values, the forward voltage of each LED is adjusted/set (step 530). The LEDs are then modulated with current control that is, for example, a Pulse Width Modulation (PWM) or similar technique. The PWM is determined, for example, in on-the-fly processing of an image signal (e.g., video signal received via cable, broadcast reception, media player, etc). The PWM of the LEDs provides, for example, backlighting that projects an image (e.g., low resolution version of a desired image) onto a second modulator for further refinement of an image to be displayed. The PWM of the current is a control that is independent of the forward voltage control setting of the LEDs.

Figure 6:
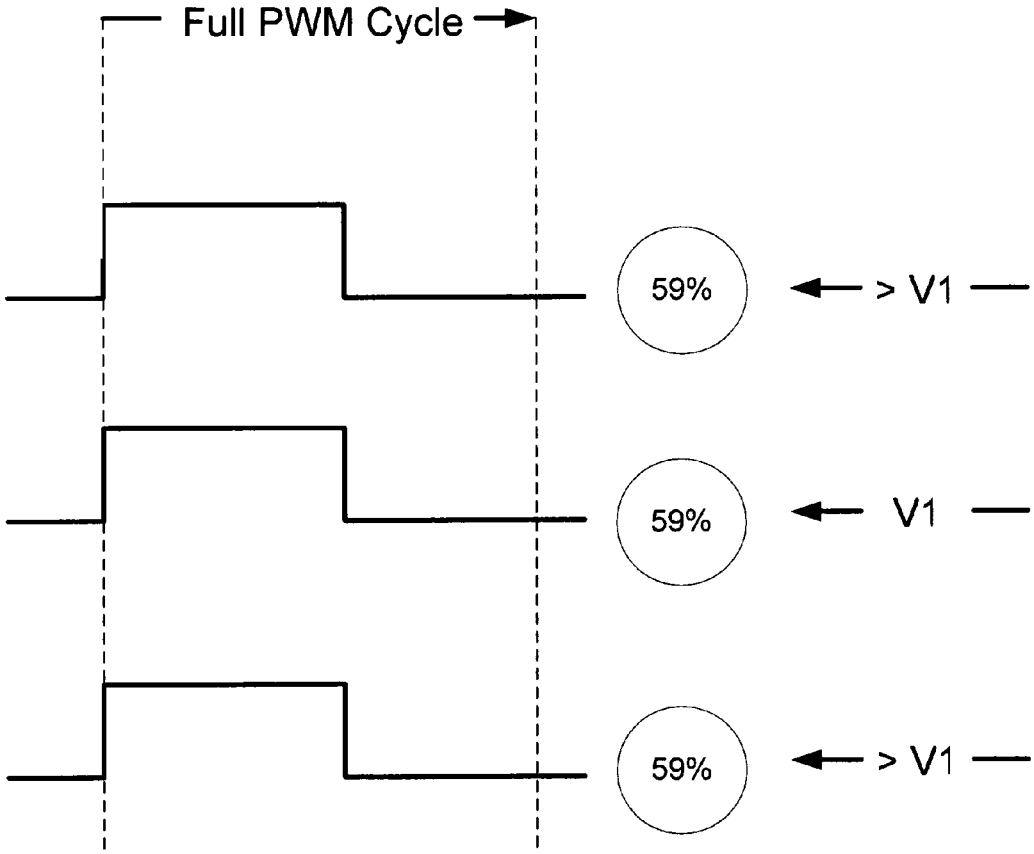
FIG. 6 is an illustration of LED voltage and drive control according to an embodiment of the present invention.

An immediate advantage of this approach is that the calibration process has been separated (e.g., completely independent) from the PWM process controlling the LED "on time". This means the PWM cycle can reach low drive values not reachable with the Gain-Offset approach. It also means the full range of PWM is available for any given PWM word length. The desired result is illustrated in FIG. 6, where LED 610, 620, and 630 each have the same % brightness from the same PWM cycle by using the selected forward voltages for each LED.

In operation, by adjusting the forward voltage up, the peak achievable current is increased, and the brighter the LED will appear. By adjusting the forward voltage down, the peak current flow is reduced, and the LED will appear dimmer. Since the duration of the current pulse has not been touched, the full range of PWM control has been preserved, while simultaneously ensuring each LED will produce the same light output at any given PWM drive value.

For an HDR display, this means the maximum possible modulation range of the backlight has been preserved. The voltage control allows each LED to reach minimum brightness and can be modulated over the full PWM range. One way to implement the voltage control is with multiple power rails, each at a slightly different voltage. For instance, a power rail for every voltage between 3.2V and 3.7V in 0.1V increments. The concept can be extended further, with a switch between each LED and the various power rails, allowing for real-time on-the-fly compensation as LED light output falls as LEDs age. This also works with non-PWM techniques such as PCM, polyphase, etc. Alternatively, if the LED aging characteristics are well understood, an algorithm for aging compensation can be implemented where the forward voltages are adjusted over time in an automatic manner, thereby preserving luminance uniformity.

In one embodiment, the LEDs are multi-colored LEDs (e.g., red, green, and blue wavelength emitting LEDs). The forward voltage may be adjusted up/down from the calibrated values for each color based on other factors (e.g., an efficiency of optics used in the display system for each color).

In some systems, the present invention may be a combination of the technique described and binning. The binning may be performed at a lower tolerance than needed for a uniform match of all light sources. The calibration and forward voltage setting is then performed to fine tune the LEDs to a desired operational tolerance.

The present invention includes variations of light source clusters (e.g., LED clusters) that operate entirely together (single forward voltage for each cluster and a single PWM signal for each cluster), or, preferably, parsed such that each cluster receives a PWM signal and each light source within each cluster is provided its own individually calibrated forward voltage. In multi-color embodiments, each cluster may receive plural PWM signals (e.g., one of each color or one for each individual waveband of color contained in the cluster). In this manner a uniform backlight with uniform clusters is provided.

In one embodiment, the present invention is advantageous for use in backlight control and calibration of clusters using variable sized light sources. For example, an LED cluster comprising relatively larger LEDs in combination with a plurality of smaller LEDs. In such embodiments, the larger LEDs may be calibrated at a different luminosity than the smaller LEDs. Such embodiments include, for example, separate calibrated forward voltages for each LED in the cluster and a single PWM signal for each cluster. Alternatively, each cluster receives two separate PWM signals, one for the larger LEDs and one for the smaller LEDs. Such embodiments may be extended to clusters using several different sizes of LEDs.

Although the present invention has been described herein mainly with reference to LEDs and HDR displays, the devices and processes of the present invention may be applied to light sources of other types having a similar voltage-current relationship as that of an LED or other diode-based light source and suitable for energization via PWM or another type of modulation for brightness control. In addition, the same techniques may be utilized in non-HDR displays, electronic signs and other lighting applications.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents and/or other devices which operate in a similar manner. For example, when describing an LED array, any other equivalent or similarly functioning device, such as laser arrays, OLEDs, nanotubes arranged as light sources, clusters of light sources, etc., or other devices having an equivalent function or capability, whether or not listed herein, may be substituted therewith. Furthermore, the inventors recognize that newly developed technologies not now known may also be substituted for the described parts and still not depart from the scope of the present invention. All other described items, including, but not limited to LEDs, LCD panels, memories, controllers, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention may include, for example, a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW±, micro-drive, and magneto-optical disks, ROMs, RAMs, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and control programs. Ultimately, such computer readable media further includes software for performing the present invention, as described above.

Included in the programming (software) of the general/specialized computer or microprocessor are, for example, software modules for implementing the teachings of the present invention, including, but not limited to, measuring light outputs, determining calibration values indicative of a uniform luminosity, storing calibration values, adjusting a luminosity control value (e.g., forward voltage of an LED) based on one or more calibration values, driving light sources, clusters, or arrays of light sources according to a video signal. Such programming may also include the application of a calibrated brightness control signal to a light source, and controlling a brightness of the light source using a modulation technique, and the display, storage, or communication of results according to one or more processes of the present invention.

The present invention may suitably comprise, consist of, or consist essentially of, any of element (the various parts or features of the invention, and their equivalents as described herein. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A controller for a display, comprising:

a plurality of light sources;

a voltage control device configured to set the light sources to a calibrated light output; and a light source driver configured to drive each light source to produce a desired light output from each light source;

wherein: the light sources comprise color light emitting diodes (LEDs);

the voltage control device is configured to be capable of producing low drive values, and a resultant low light output of each LED not reachable via a gain-offset approach; and a predetermined luminosity of each LED varies depending on its size and/or placement within the plurality of light sources.

2. The controller according to claim 1, wherein the voltage control device is coupled to a memory configured to stored brightness data of the backlight light sources, the brightness data comprises forward voltage information for each LED such that each LED has a predetermined luminosity for a same drive value, and the predetermined luminosity for each LED comprises a uniform luminosity.

3. The controller according to claim 1, wherein the LEDs are clustered and different drive signal corresponds each color within a cluster.

4. The controller according to claim 1, wherein the light sources are binned at precision that accounts for a precision of the calibrated light outputs.

5. A backlight controller, comprising:

a voltage control device configured to set each light source of a backlight to a calibrated light output; and a light source driver configured to modulate each light source to produce a locally dimmed output via a desired light output from each light source;

wherein the voltage control and drive control of the backlight controller function independently, and the light source driver modulation is configured to be capable of producing low drive values and a resultant low light output of each light source not reachable via a gain-offset approach.

6. The backlight controller according to claim 5, wherein each light source comprises an LED.

7. The backlight controller according to claim 5, wherein the calibrated light output is a maximum light output of the light source.

8. The backlight controller according to claim 5, wherein each light source comprises a color LED.

9. The backlight controller according to claim 5, wherein the modulation technique comprises at least one of Pulse Width Modulation (PWM) and Pulse Code Modulation (PCM).

10. The backlight controller according to claim 5, wherein the backlight controller is part of a high dynamic range dual modulation display comprising the backlight and an LCD screen; and the backlight is locally dimmed via at least one of a Pulse Width Modulation (PWM), Pulse Code Modulation (PCM), and polyphase modulation technique.

11. The backlight controller according to claim 5, wherein the voltage control device is coupled to a memory configured to stored brightness data of the backlight light sources.

12. The backlight controller according to claim 11, wherein the light sources comprises LEDs and the brightness data comprises forward voltage information for each LED such that each LED has a predetermined luminosity for a same drive value.

13. The backlight controller according to claim 12, wherein the predetermined luminosity varies for each LED depending on its size and/or placement within the backlight.

14. The backlight controller according to claim 13, wherein the predetermined luminosity for each LED comprises a uniform luminosity across the backlight.

15. The backlight controller according to claim 11, wherein the brightness data is increased over time to compensate for dimming due to aging of the light sources.

16. The backlight controller according to claim 5, wherein:

the backlight controller is part of a high dynamic range dual modulation display comprising the backlight and an LCD screen; and the backlight is locally dimmed via a Pulse Width Modulation (PWM) scheme; and the voltage control device is coupled to a memory configured to stored brightness data of the backlight light sources.

17. The backlight controller according to claim 16, wherein the light sources comprise LEDs grouped in clusters having a single forward voltage for each cluster and a PWM signal for each cluster.

18. The backlight controller according to claim 16, wherein the light sources comprise LEDs grouped in clusters and each light source within each cluster is provided its own calibrated forward voltage.

19. The backlight controller according to claim 18, wherein the forward voltages are individually calibrated.

20. The backlight controller according to claim 16, wherein the light sources comprise LEDs grouped in clusters configured to receive plural PWM signals.

21. The backlight controller according to claim 20, wherein the light sources comprise a plurality of colors, at least one color corresponding to each of the plural PWM signals received by the cluster.

22. The backlight controller according to claim 16, wherein the brightness data is changed over time.

23. The backlight controller according to claim 17, wherein the brightness data is changed over time.

24. The backlight controller according to claim 16, wherein the light sources are binned at precision that accounts for a precision of the calibrated light outputs.

25. The backlight controller according to claim 17, wherein the light sources are binned.

26. The backlight controller according to claim 17, wherein calibration data is stored and used to control the voltage supplied to the LEDs.

* * * * *